United States Patent [19]

Vogt

[11] 3,952,914

[45] Apr. 27, 1976

[54] RE-SEALABLE CONTAINER LID

[76] Inventor: Kuno J. Vogt, 5854 Kantor Court, San Diego, Calif. 92122

[22] Filed: Feb. 24, 1975

[21] Appl. No.: 552,340

[52] U.S. Cl. ..... 220/339; 220/269; 220/307; 220/335

[51] Int. Cl.[2] ..... B65D 43/14; B65D 51/04

[58] Field of Search ..... 220/260, 268, 269, 339, 220/359, 375, 307, 335

[56] References Cited

UNITED STATES PATENTS

| | | | |
|---|---|---|---|
| 3,236,409 | 2/1966 | Cross et al. | 220/260 |
| 3,738,526 | 6/1973 | Zundel et al. | 220/269 |
| 3,871,550 | 3/1975 | Chiappe | 220/339 |

*Primary Examiner*—George T. Hall

[57] ABSTRACT

A re-sealable container lid for utilization, for example, with carbonated beverage containers having a metallic lid with a pouring aperture therein and having a removable seal within the aperture which is constructed of displaceable material such as rubber or plastic. The seal consists of a base pad with a raised portion on one end forming a sealing pad and a pull tab extension on the sealing pad. The base pad is dimensioned for fitting underneath the aperture in the lid and covering said aperture with the sealing pad dimensioned for extending into and sealing the aperture. The pull tab extension extends on top of the sealing pad for opening and a pulling re-sealing operation.

4 Claims, 9 Drawing Figures

FIG. 1
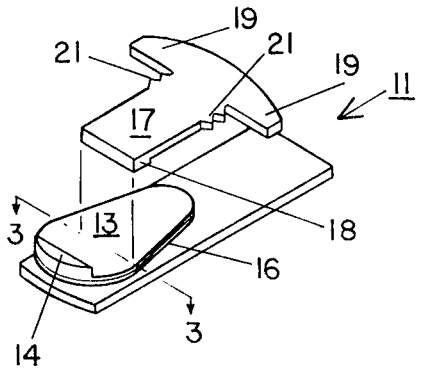
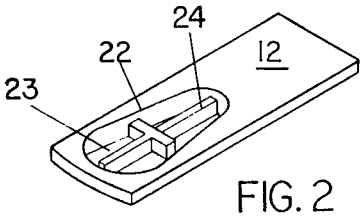
FIG. 2
FIG. 3
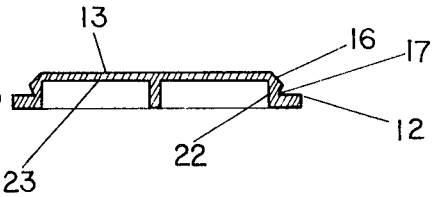
FIG. 4
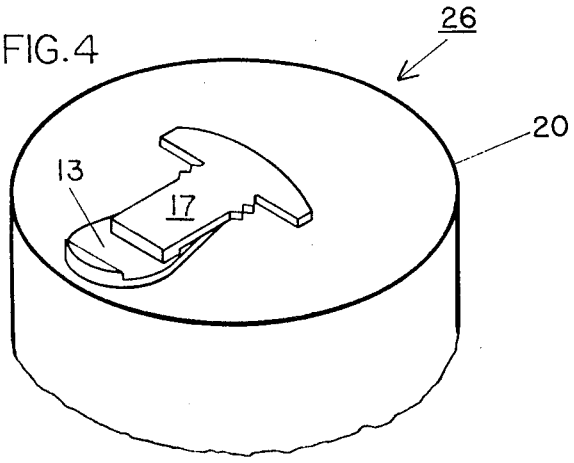
FIG. 6
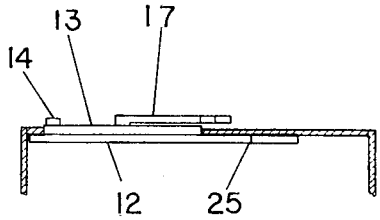
FIG. 7
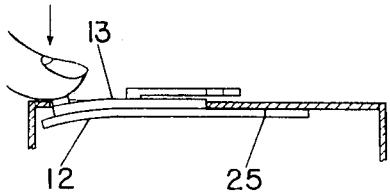
FIG. 5
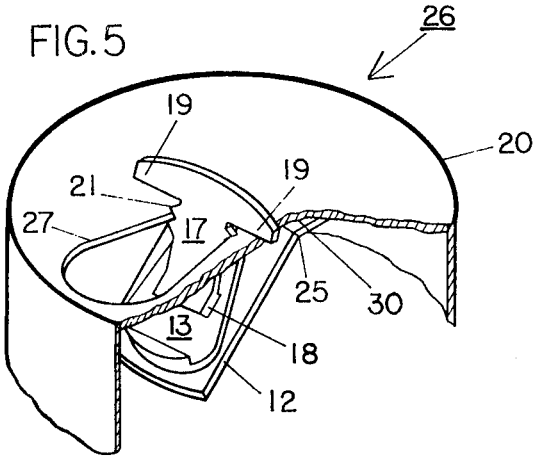
FIG. 8
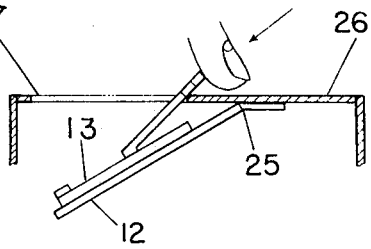
FIG. 9
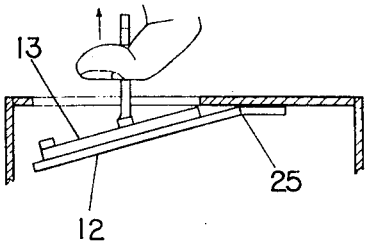

RE-SEALABLE CONTAINER LID

BRIEF DESCRIPTION OF THE INVENTION

The present invention relates to a re-sealable container lid and more particularly to a re-sealable container lid where inner pressure reinforces the seal.

According to the invention, a re-sealable container lid is provided of the type utilizing a pouring aperture in a metallic or rigid plastic lid. This type of lid is utilized for carbonated soft drinks, etc., and currently employs the use of a metallic pull tab which is scored to identify the tab itself and the pouring aperture. Many disadvantages are inherent in the pull tab type of lid, one being the tendency to litter with the pull tab itself and another being the tremendous difficulty in re-sealing the pouring aperture once it is open. The re-sealable container lid of the present invention utilizes an aperture of approximately the same dimensions as the metallic pull tab type and has a sealing assembly disposed therein. The sealing assembly is preferably constructed of a displaceable material, such as rubber or plastic and has a base or mounting pad dimensioned for fitting against the inner surface of the lid and covering the pouring aperture. The base pad is bonded to the bottom of the lid adjacent one end of the aperture and carries a raised sealing pad which is dimensioned for a press or snap fit into the aperture, effecting an hermetic seal. A pull tab extension is carried by the sealing pad extending away from the edge of the can adjacent the pouring aperture. In operation, the sealing pad is depressed with the thumb of the user until the seal is broken and the pull tab raised to a vertical position which rotates the sealing pad downward into the container where it is held by the pull tab as will be understood by reference to the detailed description below. When it is desired to re-seal the container, the pull tab is pulled in an upward position, rotating the base pad and the sealing pad back into position until a snap fit is effected with the sealing pad in the pouring aperture. It is pointed out here that through the unique construction of the present invention, any internal pressure resulting from the escape of carbon dioxide gas, for example, tends to reinforce the seal rather than destroy it since the sealing assembly can only be displaced inwardly toward the inside of the container. This construction also minimizes any problems due to a sharp metallic edge remaining after the pull tab type of lid container and since the sealing assembly is held to the container, it cannot be a source of separate litter.

An object of the present invention is the provision of a re-sealable container lid.

A further object of the invention is the provision of a re-sealable container lid for reducing litter possibilities.

Another object of the invention is the provision of a container lid which is inexpensive to manufacture and extremely convenient in use.

Other objects and many of the attendant advantages of the present invention will be readily appreciated as the same becomes better understood by reference to the following detailed description when considered in connection with the accompanying drawings in which like reference numerals designate like parts throughout the figures thereof and wherein:

FIG. 1 is a perspective exploded view of the sealing assembly of the present invention;

FIG. 2 is a bottom perspective view of the embodiment of the sealing assembly of FIG. 1;

FIG. 3 is a sectional view taken along lines 3 — 3 of FIG. 1;

FIG. 4 is a perspective view of the preferred embodiment of the present invention in a sealed condition;

FIG. 5 is a perspective view of the embodiment of FIG. 4 in an un-sealed condition;

FIG. 6 is a side elevational view partially sectioned of the embodiment of FIG. 4 in a sealed condition;

FIG. 7 is a side elevational view partially sectioned of the embodiment of FIG. 4 in a partially un-sealed condition;

FIG. 8 is a side elevational view partially sectioned of the embodiment of FIG. 4 in a completely opened position; and FIG. 9 is a side elevational view partially sectioned of the embodiment of FIG. 4 in position for re-sealing.

DETAILED DESCRIPTION OF THE DRAWING

Referring to FIG. 1, the sealing assembly is shown generally at 11 with a base pad 12 carrying a sealing pad 13. Sealing pad 13 has a thumb raised portion 14 and a bevelled edge 16. Pull tab extension 17 is carried by sealing pad 13 at a lower surface 18 and has a pair of pull wings 19 with serrations 21 on each side thereof.

Referring to FIG. 2, base pad 12 is shown with a recess 22 terminating in portion 23 with reinforcement ribs 24 carried thereby.

Referring to FIG. 3, sealing pad 13 is shown with a bevelled edge 16 and an annular notched sealing recess 17 together with a shoulder formed by pad 12. Recess 22 is shown terminating at portion 23.

Referring to FIG. 4, the entire lid assembly is shown at 26 with rigid lid portion 20, sealing pad 13 and pull tab extension 17 on the surface thereof.

Referring to FIG. 5, lid assembly 26 is shown with pouring aperture 27 therein. Base pad 12 carries sealing pad 13 which in turn carries pull tab extension 17 at 18. Pull wings 19 of pull tab extension 17 extend beyond the edges of aperture 27 and serrations 21 are in contact therewith.

Referring to FIGS. 6–8, base pad 12 carries sealing pad 13 disposed within aperture 27 of lid section 26; sealing pad 13 carries pull tab extension 17. Sealing pad 13 is dimensioned for a snap sealing fit within aperture 27 of lid section 26.

OPERATION

Referring now to all of the figures, while the various major components, i.e. the base pad 12, sealing pad 13, and pull tab extension 17, are shown as being separately fabricated and bonded together, in actuality, it is contemplated that they will form one integral molded part. Referring specifically to FIG. 5, base pad 12 is bonded at surface 30 to the bottom surface of lid portion 27 of the entire assembly. A score indicated at 25 allows the base pad to be bent downward when depressed by a user's thumb as in FIG. 7, and rotated by pull tab extension 17, more particularly shown in FIGS. 5, 8 and 9. In the initial assembly, sealing pad 13 is pressed into pouring aperture 27 via the bevelled edge 16 and annular notched recess 17. At this point, pad 12 forms a seal around the perimeter of and underneath pouring aperture 13. It can be seen that if internal pressure is built up within the container, the resultant forces will be against the bottom of base pad 12 which will tend to force pad 12 further against the bottom surface surrounding the aperture 13. At the same time pressure will be exerted against the wall of recess 22 of base pad 12 and sealing pad 13 forcing the notched recess 17 against the edge of pouring aperture 27. Referring specifically to FIG. 2, the recess 22 goes through base pad 12 and into sealing pad 13. This allows for a certain amount of displacement toward the center when the press fit seal is effected. Reinforcing ribs 24 do not reach the walls of recess 22.

Referring to FIGS. 6, 7, 8 and 9, it can be seen that by depressing the thumb protuberance 14 as shown in FIG. 7, the seal is broken and as pull tab extension 17 is lifted and depressed the base pad 12 pivots at score 25 allowing the entire assembly to rotate in a counterclockwise direction at opening of pouring aperture 27. When a re-sealing is desired, the pull tab extension 17 is grasped by extensions 19 and pulled upwardly, effecting a snap fit of the sides of aperture 27 into annular notches recess 17 (FIG. 3).

It should be understood, of course, that the foregoing disclosure relates to only a preferred embodiment of the invention and that it is intended to cover all changes and modifications of the example of the invention herein chosen, for the purposes of the disclosure, which do not constitute departures from the spirit and scope of the invention.

The invention claimed is:

1. A re-sealable container lid comprising:

a lid section constructed of rigid material and having a pouring aperture in proximity to one edge thereof;

a removable seal constructed of a displaceable material, sealably disposed in said pouring aperture;

a notched sealing recess around the periphery of said seal dimensioned for receiving the edge of said pouring aperture in a sealed condition; and a mounting pad extending from said removable seal and being attached on one side to a bottom surface of said rigid lid section.

2. The re-sealable container lid of claim 1 and further including:

a pull tab extension extending from said seal over a top surface of said lid section.

3. The re-sealable container lid of claim 2 wherein:

said pull tab extension has serrated edges dimensioned for contact with the edge of said pouring aperture.

4. The re-sealable container lid of claim 1 and further including:

a recess in the bottom surface of said base pad, said recess extending into said seal.

* * * * *